US005758385A

United States Patent [19]

Waldner

[11] Patent Number: 5,758,385

[45] Date of Patent: Jun. 2, 1998

[54] BROOM CAP

[75] Inventor: David J. Waldner, Crossfield, Canada

[73] Assignee: Neudorf Hutterian Brethern, Alberta, Canada

[21] Appl. No.: 687,957

[22] Filed: Jul. 29, 1996

[51] Int. Cl.[6] ..... A46B 3/02

[52] U.S. Cl. ..... 15/176.2; 15/171; 15/176.1; 15/176.3; 15/193; 15/204

[58] Field of Search ..... 15/159.1, 168, 15/171, 173, 175, 176.1–176.3, 191.1, 192, 193, 204, 205

[56] References Cited

U.S. PATENT DOCUMENTS

| | | | |
|---|---|---|---|
| 48,232 | 6/1865 | Bolender | 15/204 |
| 67,745 | 8/1867 | Forker | 15/204 |
| 70,542 | 11/1867 | Forker | 15/204 |
| 246,326 | 8/1881 | Magi | 15/173 |
| 258,874 | 6/1882 | Bartlett | 15/204 |
| 307,711 | 11/1884 | Fish | 15/204 |
| 362,351 | 5/1887 | Bartlett | 15/204 |
| 367,031 | 7/1887 | Fish | 15/204 |
| 2,064,949 | 12/1936 | Rolker | 15/192 |
| 2,080,821 | 5/1937 | Jacob, Jr. et al. | 15/192 |
| 3,133,299 | 5/1964 | Danley et al. | 15/193 |
| 3,609,792 | 10/1971 | Wiese | 15/193 |
| 4,541,139 | 9/1985 | Jones et al. | 15/171 |
| 5,289,606 | 3/1994 | Ledingham | 15/204 |
| 5,485,648 | 1/1996 | Balducci et al. | 15/159.1 |

FOREIGN PATENT DOCUMENTS

| | | | |
|---|---|---|---|
| 116356 | 12/1992 | Australia | 15/193 |
| 470108 | 1/1929 | Germany | 15/171 |
| 1049353 | 1/1959 | Germany | 15/171 |
| 554883 | 1/1957 | Italy | 15/171 |
| 589084 | 2/1959 | Italy | 15/193 |
| 5798 | of 1913 | United Kingdom | 15/205 |

*Primary Examiner*—Mark Spisich
*Attorney, Agent, or Firm*—Jones, Tullar & Cooper, P.C.

[57] ABSTRACT

A cap for a broom has a shroud that simulates the appearance of the head of a straw broom and has front, rear, end and top walls defining an internal cavity. A cylindrical socket extends inwardly of the cavity from the top wall and may be threaded to receive the threaded end of a broom handle. A collar upstanding from the top wall provides additional support for the handle. An integrally moulded post projects into the cavity from the bottom of the socket and a nut, preferably a wing nut, is threadably secured to the post. The shroud can be filled with straws and a curable mass poured into the cavity to bind the straws together. The nut will be embedded within the curable mass as it cures and will prevent the mass and straws from coming out of the shroud during use.

8 Claims, 3 Drawing Sheets

BROOM CAP

The present invention relates generally to the art of brooms and other sweeping devices and more particularly to a cap construction for a broom.

BACKGROUND OF THE INVENTION

It is known to construct brooms with a cap member that is preformed, the cap member receiving the broom's straws therein and being connectable to a suitable handle member that extends away from the cap member. It is also known to anchor corn straws, or plastic straws, in a curable resinous or rubber-like material, which material cures within the cap member and holds the straws in the cap member. U.S. Pat. Nos. 2,064,949; 3,133,299; and 3,609,792 all show such cap members or shrouds. In each of these prior art cap members the curable mass is anchored in place by way of an element which projects into the mass. In each case that element is directly or indirectly a part of the handle member. Since the handle member is anchored to the curable mass that anchors the straws it is not possible to disassemble the handle member from the cap member to replace, for example, a broken handle member. Manufacture of the broom is also complicated since the handle member must be assemble to the cap member before the straws are placed in the cap member and the curable mass is poured into the cap member. Curing must take place with the handle member already assembled to the cap member, which can also pose a problem.

SUMMARY OF THE INVENTION

The present invention overcomes the problems associated with prior art broom assemblies using preformed cap members. In this case the cap member is moulded with a post member projecting into the cap member from the top wall of the cap member and a nut member is provided for threaded assembly to the post member. The nut member is enlarged relative to the post member, with the body thereof extending laterally from the post member. The straws can be positioned in the cap member and the curable mass, such as a polyester resin, is poured into the inverted cap member. As the curable mass cures it will solidify around the nut member and the nut member thus will anchor the curable mass and the straws embedded therein within the cap member, preventing them from falling out of the cap member.

Preferably the nut member takes the form of a wing nut having a pair of opposed wing portions that extend radially away from the post member when it is in place. The wings provide a greater anchoring effect once the curable mass has solidified.

Preferably, also, the cap member has a hollow, inwardly extending socket member with an internal threaded portion at the inner end thereof. A handle having an external thread at one end thereof can be threaded into the socket member so as to provide a completed broom. An upstanding collar portion may be provided as an extension of the socket member, giving additional support for the handle.

Generally speaking therefore the present invention can be considered as providing a cap for a broom construction comprising: a moulded plastic shroud member having front, rear, end and top walls defining a cavity; a socket member depending from the interior of the top wall and extending into the cavity; means for securing a handle member within the socket member; a post section extending from an end wall of the socket member further into the cavity; and an enlarged nut member threadable onto the post section; whereby with the nut member threaded onto the post section the cavity can receive a plurality of straws and a curable bonding material in which the straws are embedded, the nut member serving to anchor the embedded straws in the cavity after the curable material has cured.

BRIEF DESCRIPTION OF THE DRAWINGS

The invention will be described herein with respect to the drawings wherein.

DESCRIPTION OF THE PREFERRED EMBODIMENT

Figure 1:
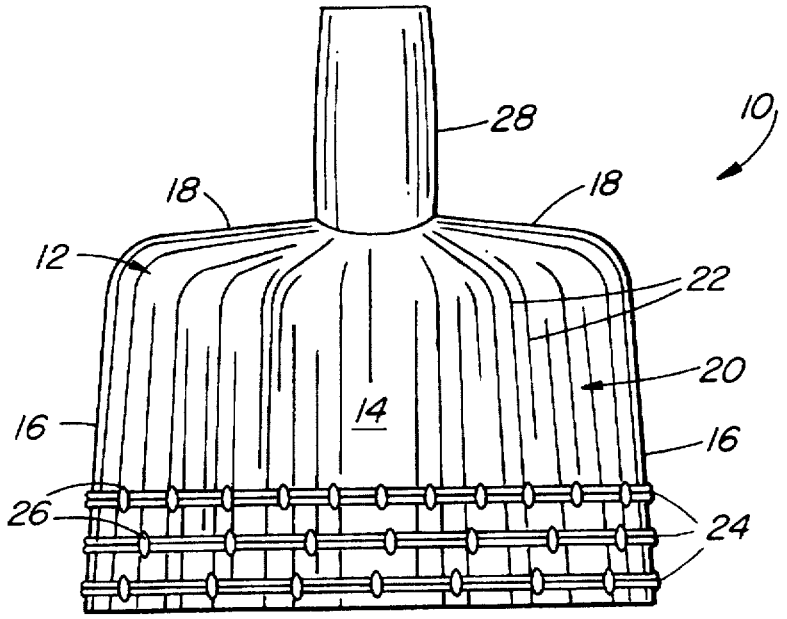
FIG. 1 is an elevational view of the cap member of the present invention.

A cap 10 in accordance with the present invention is illustrated in FIG. 1. The cap 10 includes a shroud member 12 having identical front and rear walls 14,14 and identical rounded end walls 16,16. A rounded and slightly sloping top wall 18 is smoothly joined to the front, rear and end walls. The shape of the shroud member is intended to simulate the appearance of the upper, bound portion of a typical straw broom. The shroud member 12 is integrally moulded from a suitable, inexpensive plastics material and is provided with surface decoration 20 that is intended to further the simulated broom appearance. That surface decoration may include fine raised ribs 22 simulating straws, peripheral ribs 24 simulating binding twine, and spaced apart generally vertical ribs 26 simulating the threads that would hold a typical straw broom together. In the preferred embodiment a collar portion 28 projects upwardly from the top wall 18 of the shroud member 12.

Figure 2:
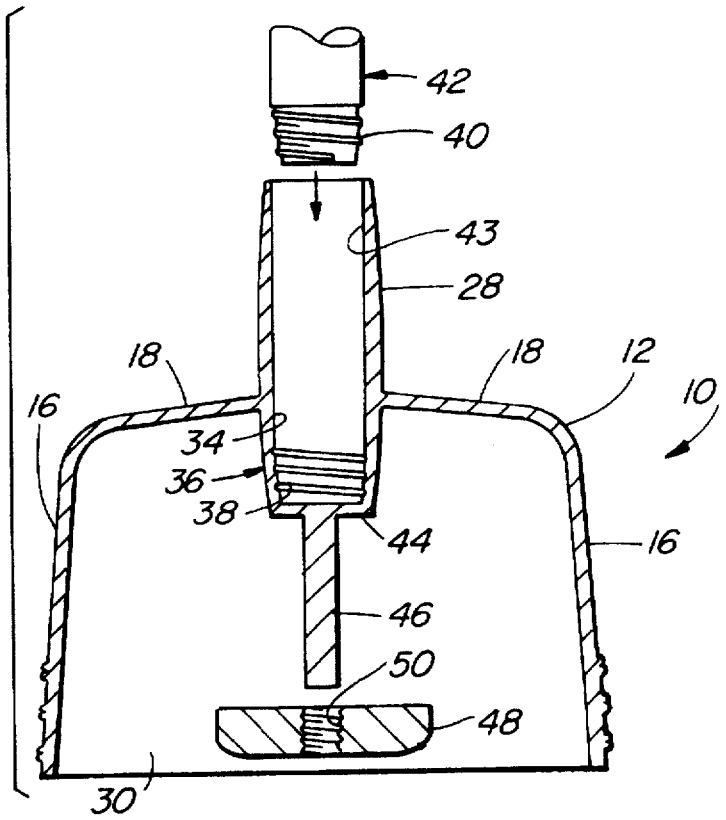
FIG. 2 is a cross-sectional view taken on the line 2-2 of FIG. 1.

FIG. 2 illustrates the interior of the shroud member 12, it being noted first of all that the walls 14, 16 and 18 are all quite thin and define an interior cavity 30. That cavity will receive the straws that constitute the sweeping elements of the finished broom. Projecting inwardly of the cavity from the top wall 18 is a socket member 32 which includes a smooth generally cylindrical interior wall 34 and, at the lower end thereof, a slightly reduced diameter portion 36 that includes securing means for a broom handle. In the preferred embodiment the reduced diameter portion 36 is internally threaded as at 38 so as to receive the externally threaded end 40 of a standard broom handle 42. As can also be seen in Figure 2 the collar portion 28 has an interior wall 43 that is continuous with the interior wall 34 of the socket member, the diameter of the walls 34 and 43 being on slightly greater than the diameter of a standard broom handle whereby the socket member 32 and the collar portion 28 provide full support for the broom handle and strengthen the connection between the broom handle and the shroud member.

Projecting into the cavity 30 from the bottom wall 44 of the socket member 32 is a post section 46 that is integrally moulded with the cap 10. The post section 46 is solid and tapers slightly towards its free end. A nut member 48 is provided, the nut member being enlarged laterally and having a threaded bore 50 that is receivable on the post section 46. One can rotate the nut member so as to thread it onto the post section 46, the threads of the nut member cutting their own threads onto the post section itself. Thus it is not necessary to mould threads onto the post section 46 during moulding of the shroud member 12.

Figure 2A:
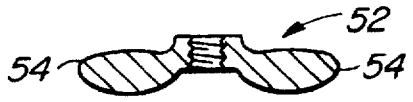
FIG. 2*a* illustrates a wing nut member that could be used with the present invention.

Although a typical large hexagonal nut member 48 will work with the present invention it is preferred that the nut member be a wing nut as shown in FIG. 2*a* at 52. That wing nut has a pair of diametrically opposed enlarged wings 54 that extend radially from the central portion of the nut.

Figure 3:
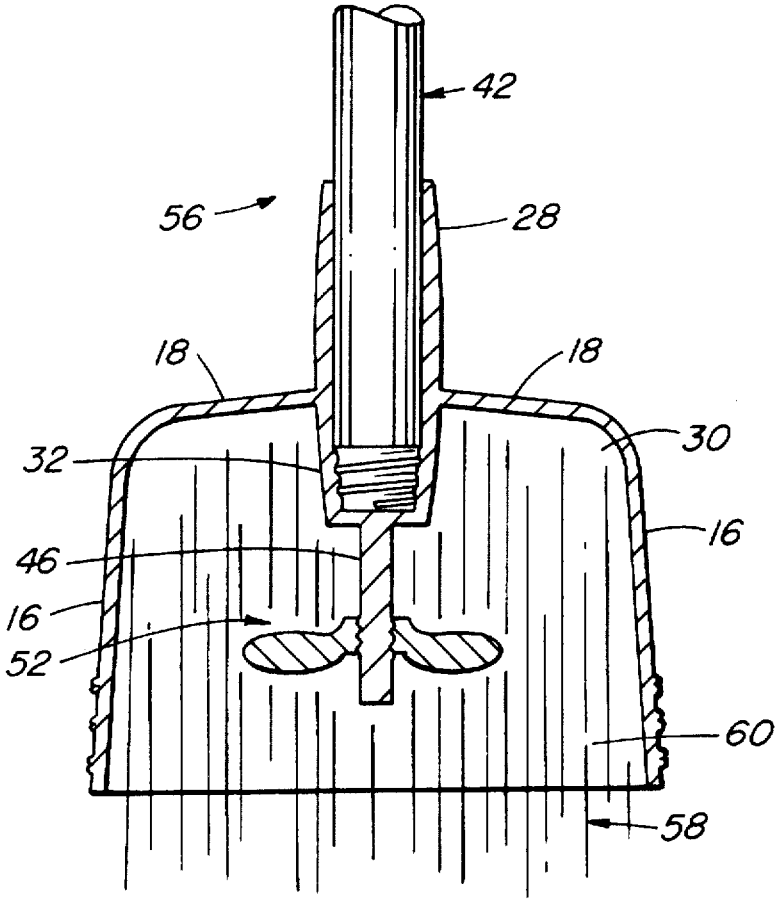
FIG. 3 shows a partial cross-sectional view, similar to FIG. 2 but with all components of the broom in place.

Turning now to FIG. 3 an assembled broom 56 in accordance with this invention is illustrated. The broom 56 includes the shroud member 12 with a wing nut 52 threaded onto the post section 46. A handle 42 is located within the collar portion 28 and the socket member 32 and is threaded into the internally threaded portion 38 of the socket member 32. A dense mass of straws 58 has been pushed into the cavity 30 and a curable mass 60 has been poured into the cavity 30 so as to surround the straws therein. The curable mass could, for example, be a polyester resin, a rubber-like material, or a silicone material, that will cure and solidify so as to embed the straws therein, binding the straws together and possibly to the shroud. The straws could be either natural or artificial.

While there may be some bonding between the curable mass 60 and the walls of the shroud member 12 there is no guarantee that the solidified curable mass and the embedded straws will not detach from the shroud member with continuous use of the broom 56. By using the present invention, however, this possibility is greatly reduced, since the curable mass will solidify about the nut member 48 or 52 and the nut member will thus be embedded itself in the curable mass 60. As the nut member is threaded to the post section 46 and the post section is an integral part of the shroud member 12 it will be almost impossible for the straws to fall from the shroud member 12.

As indicated above, a typical hexagonal nut member will work with the present invention but a wing nut such as 52 is preferred. The wings 54 project outwardly farther than the flats of a hexagonal nut and provide improved grip when they are trapped in the cured, solidified mass. It does not matter whether the wings 54 are in any particular orientation with respect to the axes of the shroud member. It is only important that the nut member be threaded onto the post section a sufficient distance to provide a strong threaded connection between the nut member and the post section.

Figure 4:
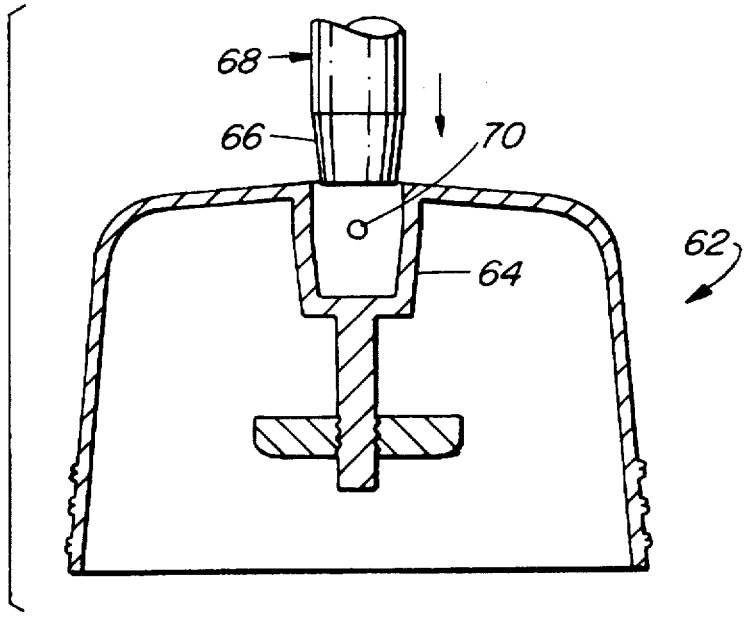
FIG. 4 is a cross-sectional view similar to FIG. 2 but of a simplified embodiment of the invention.

The foregoing has described a preferred embodiment of the present invention. It is expected, however, that modifications to the cap of this invention could be made, depending on the end use of the broom to be manufactured using the cap of the invention. For example, a light duty broom may not need the collar portion 28 and/or it may not need a threaded socket member for the broom handle, especially since not all handles are threaded. Some broom handles have a tapered smooth end that has either a tight fit in an appropriate socket or is fixed in the socket by a nail or a screw. FIG. 4 illustrates a simplified embodiment of this invention whereby the top of the shroud member 62 is devoid of a collar and the inner wall of the socket member 64 is smooth, receiving a smooth tapered end 66 of a handle member 68. In this case the front or the rear wall of the shroud member is provided with a hole 70 communicating with the interior of the socket member so that a nail or a screw can be driven through the hole into the handle member to secure it to the shroud member.

Figure 5:
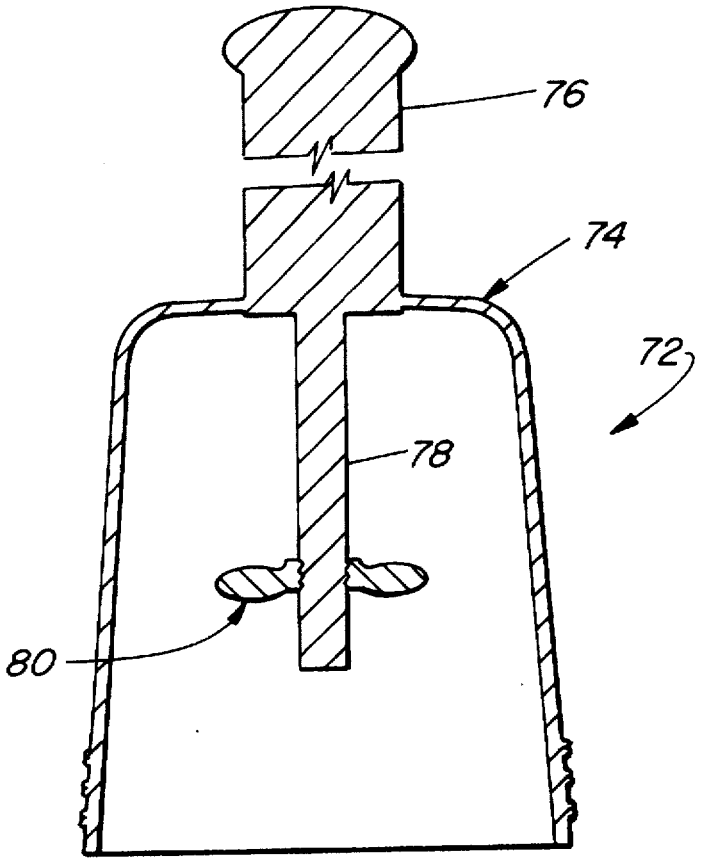
FIG. 5 is a cross-sectional view of a whisk-like broom incorporating the present invention.

FIG. 5 illustrates another, simplified, embodiment of the invention, this being a cap 72 for a small whisk-like broom. The cap 72 includes a shroud member 74 not unlike, but smaller than, the shroud members previously described. The cap includes a handle member 76 integrally moulded at the top of the shroud member 74 and a post member 78 integrally moulded within the interior of the shroud member. The post member would be slightly tapered as with the earlier-described embodiments. A nut member such as a wing nut 80 is provided for threaded engagement with the post member so that straws and a curable mass (not shown) may be placed within the shroud member and anchored thereto once the curable mass has cured about the nut member. This embodiment is simple and economical to produce and has the handle portion thereof integrally formed with the cap, obviating the need for a separate handle and means for attaching such a handle to the shroud member.

Other modifications could be effected without departing from the spirit of the present invention and accordingly the protection to be afforded this invention is to be determined from the claims appended hereto.

I claim:

1. A cap for a broom construction comprising:

a moulded plastic shroud member having front, rear, end and top walls defining a cavity;

a socket member depending from the interior of said top wall and extending into said cavity;

means for securing a handle member within said socket member;

a post section extending from an end wall of said socket member further into said cavity; and an enlarged nut member threadable onto said post section;

whereby with said nut member threaded onto said post section said cavity can receive a plurality of straws and a curable bonding material in which said straws are embedded, said nut member serving to anchor said embedded straws in said cavity after said curable material has cured.

2. The cap of claim 1 wherein said nut member is a wing nut having a pair of diametrically opposed and outwardly extending wing portions.

3. The cap of claim 1 wherein said securing means comprises an internally threaded portion of said socket member, adapted to receive a threaded end of a handle member.

4. The cap of claim 2 wherein said securing means comprises an internally threaded portion of said socket member, adapted to receive a threaded end of a handle member.

5. The cap of claim 3 including an annular collar portion integrally moulded with said shroud member and extending away from said top wall, said collar portion having an interior wall that is continuous with the interior wall of said socket member.

6. The cap of claim 4 including an annular collar portion integrally moulded with said shroud member and extending away from said top wall, said collar portion having an interior wall that is continuous with the interior wall of said socket member.

7. The cap of claim 3 wherein said shroud member is moulded with surface decoration simulating the appearance of a typical straw broom.

8. The cap of claim 4 wherein said shroud member is moulded with surface decoration simulating the appearance of a typical straw broom.

* * * * *